United States Patent [19]

Smith et al.

[11] Patent Number: 5,062,393

[45] Date of Patent: Nov. 5, 1991

[54] ENGINE CYLINDER LINER, SEALS AND ASSEMBLY THEREWITH

[75] Inventors: Stephen Smith, Downers Grove; Dale F. Engelhardt, Orland Park, both of Ill.

[73] Assignee: General Motors Corporation, Detroit, Mich.

[21] Appl. No.: 600,958

[22] Filed: Oct. 22, 1990

[51] Int. Cl.[5] ..... F02F 1/10

[52] U.S. Cl. ..... 123/41.72; 123/41.84; 277/235 B

[58] Field of Search ..... 123/193 C, 193 CH, 41.72, 123/41.79, 41.81, 41.83, 41.84; 277/157, 231, 235 R, 235 B

[56] References Cited

U.S. PATENT DOCUMENTS

| | | | |
|---|---|---|---|
| 3,377,996 | 4/1968 | Kotlin et al. | 123/41.31 |
| 3,436,085 | 4/1969 | Polk | 123/193 CH |
| 3,664,676 | 5/1972 | Petersen | 277/235 B |
| 4,093,842 | 6/1978 | Scott | 219/121 LM |
| 4,860,700 | 8/1989 | Smith | 123/41.31 |
| 4,918,805 | 4/1990 | Liszka et al. | 29/888.06 |

*Primary Examiner*—Noah P. Kamen

*Attorney, Agent, or Firm*—Robert J. Outland

[57] ABSTRACT

Bore distortion from assembly of a jacketed cylinder liner and cylinder head is reduced by provision of a heavy uniform liner flange for evenly distributing the assembly stresses. Multiple drilled coolant passages between stud holes in the flange provide bore cooling and elongated manifold recesses distribute the coolant to non registering inlet holes in the cylinder head. Elongated seals with insulators and shields for support are also provided to seal the manifold connections at the head-liner interface.

14 Claims, 3 Drawing Sheets

ENGINE CYLINDER LINER, SEALS AND ASSEMBLY THEREWITH

TECHNICAL FIELD

This invention relates to internal combustion engine cylinder liners and particularly to coolant jacketed cylinder liners for diesel engines. In a specific embodiment, the invention relates to low distortion coolant jacketed cylinder liners for two cycle diesel engines and the like wherein the liner has an upper flange that is secured by stud fasteners to an associated cylinder head with coolant flow passing through the flange between the liner jacket and the head.

BACKGROUND

It is known in the art relating to diesel engine cylinders to provide a cast bore having a surrounding coolant jacket which may be cast integrally or formed otherwise such as by a fabricated assembly of a cast bore section and an outer sleeve brazed or otherwise secured to the casting to form an annular coolant jacket.

In a commonly used liner for two cycle engines, a flange is provided with eight equally spaced studs which are threaded into the liner flange and extend therefrom for retention of an associated pot type cylinder head in sealing engagement with flange. The studs are seated in thickened portions of the flange formed as ribs which connect inner and outer portions and blend downward into the bore wall.

Between the ribs, the flange is hollow to form upper extensions of the coolant jacket that cool the upper bore and pass coolant into drilled passages that carry the coolant to the cylinder head. Sections of the flange between liner studs are provided alternately with one or two drilled passages forming coolant outlet openings which are aligned with inlet openings formed in the associated cylinder head.

One such prior cylinder liner is shown in U.S. Pat. No. 4,093,842 issued June 6, 1978. That liner is of fabricated construction having an alloy cast iron body and flanges receiving separately formed sleeves closing upper and lower coolant jackets that are connected through coolant passages extending between centrally located air inlet ports. Other prior liners have been made with fully cast bodies forming integral coolant jackets.

As shown in Pat. No. 4,093,842, the prior liner upper flange 26 includes hollow portions extending upwardly from the coolant jacket 38 to cool the upper bore wall 24. Passages 48 through the flange 26 connect the jacket 38 with inlet openings 19 of an associated cylinder head 10 as shown in FIG. 1 of U.S. Pat. No. 4,918,805 issued Apr. 24, 1990.

Between the hollow portions, the flange 26 of liners like that of Pat. No. 4,093,842 has ribs, not shown, extending to the bottom of the flange and below it with the bore wall 24. In these ribs are threaded openings, not shown, to receive eight studs, not shown. In assembly with a head similar to that of Pat. No. 4,918,805, these studs extend through bores 22 in the barrel 12 of the associated cylinder head 10 for securing the barrel against the liner flange.

Typically, a thin metal combustion gasket is used between the head and liner surfaces to seal combustion gases, although other types of gaskets have been used. Annular grommets (resilient seal rings) with or without surrounding insulator rings have been used as seals in individual flange recesses to seal the joints between the liner and cylinder head coolant passages against leakage of coolant.

Such cylinder liners have given many years satisfactory service in commercial use. However, it has been found that the high clamping forces applied to the studs for retaining the associated liner and cylinder head in sealing engagement have tended to cause some distortion of the upper cylinder bore, apparently due to an outward pulling of the bore wall at the rib locations.

SUMMARY OF THE INVENTION

The present invention provides an improved liner design that significantly reduces upper bore distortion due to clamping or assembly stresses of the liner with the cylinder head. To reduce the distortion, the upper flange has been made uniformly heavy by essentially filling in the spaces between the ribs to form a rib-free annulus of constant axial length. While the present embodiment is formed with a cast bore and flange portion with separate jacket sleeves provided to form a fabricated assembly, it is within the scope of the invention to form the liner as an integral casting, such as by lost foam casting, or with any other manner of construction or method of manufacture which may be suitable.

Cooling of the upper bore within the heavy flange is provided by a plurality of passages drilled or otherwise formed circumferentially spaced and extending axially through each of the flange sections between adjacent studs. In a preferred embodiment, three parallel passages provided between each of the stud locations replace the previous hollow portions of the flange between the ribs and the alternate one or two drilled outlet passages connecting with the cylinder head passages and coolant jacket.

To provide suitable connection of the three liner passages in each between-stud segment of the liner flange with the one or two passages in the associated cylinder head segment, the outer end of the flange is provided with manifolds in the form of recesses that interconnect the outer ends of the three passages through each segment of the liner flange.

A wire combustion gasket is preferably located in an annular recess around the inner edge of the liner bore at the flange end to engage the cylinder head and provide a combustion seal. While other suitable combustion gaskets could be used, the limited compression wire material is believed to provide superior elastic recovery for continued sealing upon stretch relaxation of the liner studs after assembly or in service.

Suitable seal means are provided for installation around the peripheries of the manifold recesses so as to sealingly engage the face of the associated cylinder head upon assembly and prevent leakage of the coolant at the joint. In a preferred embodiment, these seal means comprise an elongated elastomeric seal of D-shaped cross section, an annular insulator ring slipped around the seal to protect it from exhaust gas heat, and a stainless steel ferrule located inside the seal to support it against collapse from outside pressure such as a build-up of carbon against the seal exterior from the cylinder head exhaust ports.

These and other features and advantages of the invention will be more fully understood from the following description of certain specific embodiments of the invention taken together with the accompanying drawings.

BRIEF DRAWING DESCRIPTION

DETAILED DESCRIPTION

Figure 1:
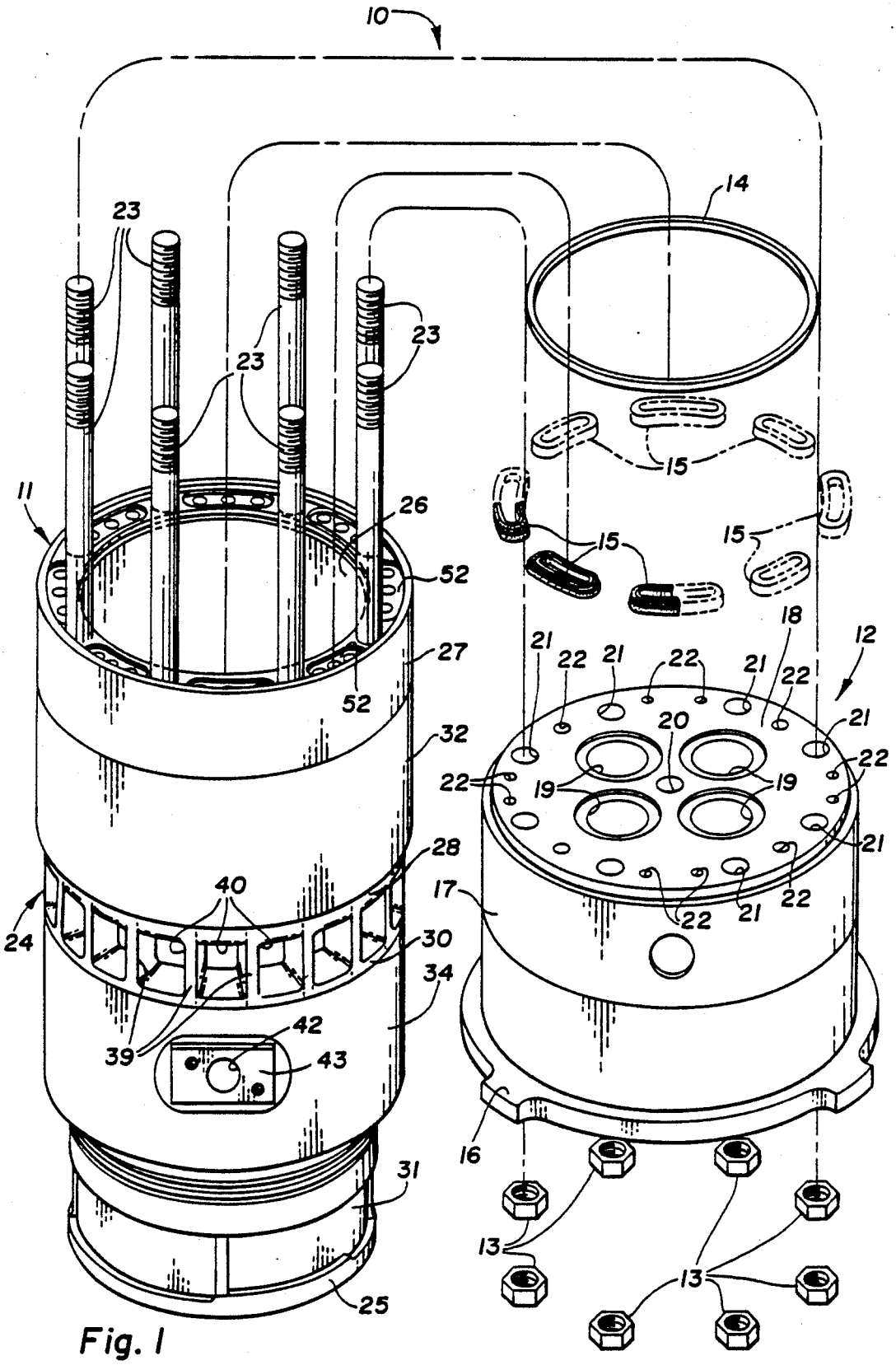
FIG. 1 is an exploded pictorial view of an engine cylinder assembly including a head and a liner with seal means according to the invention.

Referring now to the drawings in detail, numeral 10 generally indicates an engine cylinder assembly shown pictorially in an exploded manner. Assembly 10 includes a cylinder liner assembly 11, cylinder head 12, retaining nuts 13, metallic combustion seal ring or gasket 14 and eight coolant seal assemblies 15. The cylinder assembly shown is of a type particularly intended for use in two cycle diesel engines manufactured by the Electro-Motive Division of General Motors for use in railway locomotives, marine vessels and various power applications but the invention is not intended to be limited to use in such engines.

The head 12 shown is of the individual cylinder or pot type and represents a construction forming part of the prior art. It includes an upper mounting flange 16 and a depending barrel 17 terminating at the bottom in a lower wall or fireface 18. In the fireface, there are four exhaust valve ports 19 and an injector opening 20 centered between the valve ports. A compression relief opening, not numbered, is also shown. Around the periphery of the fireface are eight equally spaced stud receiving bores 21 that extend upward through the head for securing it to a liner. Spaced between the bores 21 in alternate groups of one and two are twelve coolant inlet holes 22 that lead to a coolant jacket, not shown, within the head.

The cylinder liner assembly 11 includes eight liner studs 23 of previously known configuration assembled with a fabricated cylinder liner 24 that includes novel features to be later described. The nuts 13 engage the studs. 23 in assembly and may be used with hardened washers, not shown, to retain the head in sealing engagement with the liner. The combustion gasket 14 and the coolant seal assemblies 15, with their separate components, also have novel features and/or are combined with the liner and head to form novel assemblies according to the invention.

Figure 2:
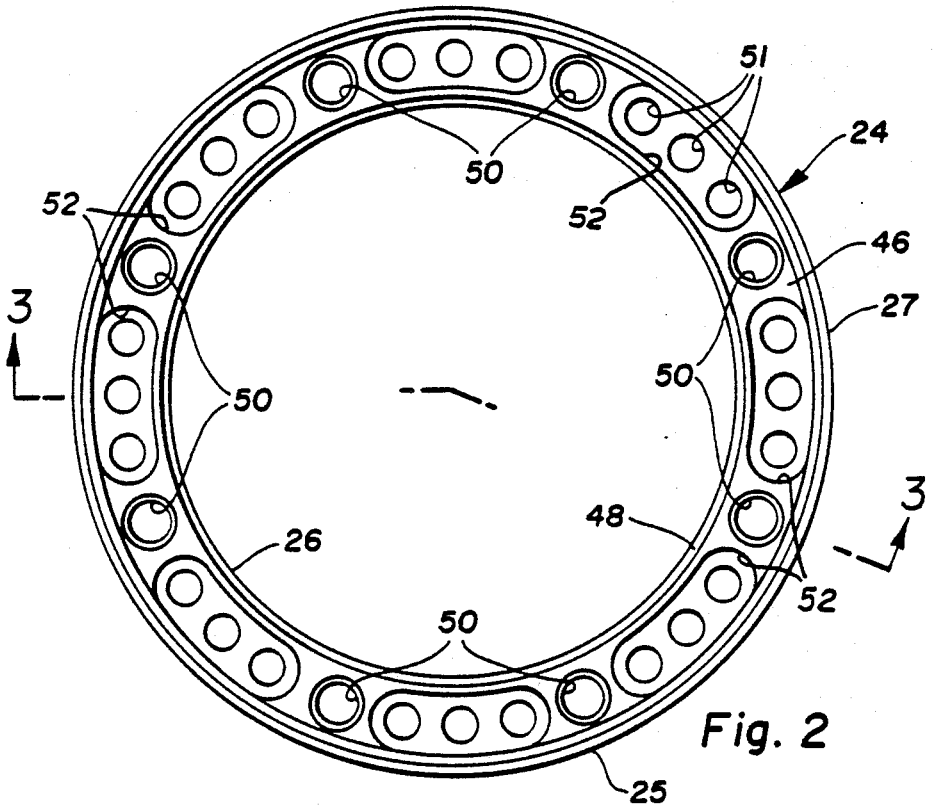
FIG. 2 is a top plan view of the liner of FIG. 1.
Figure 3:
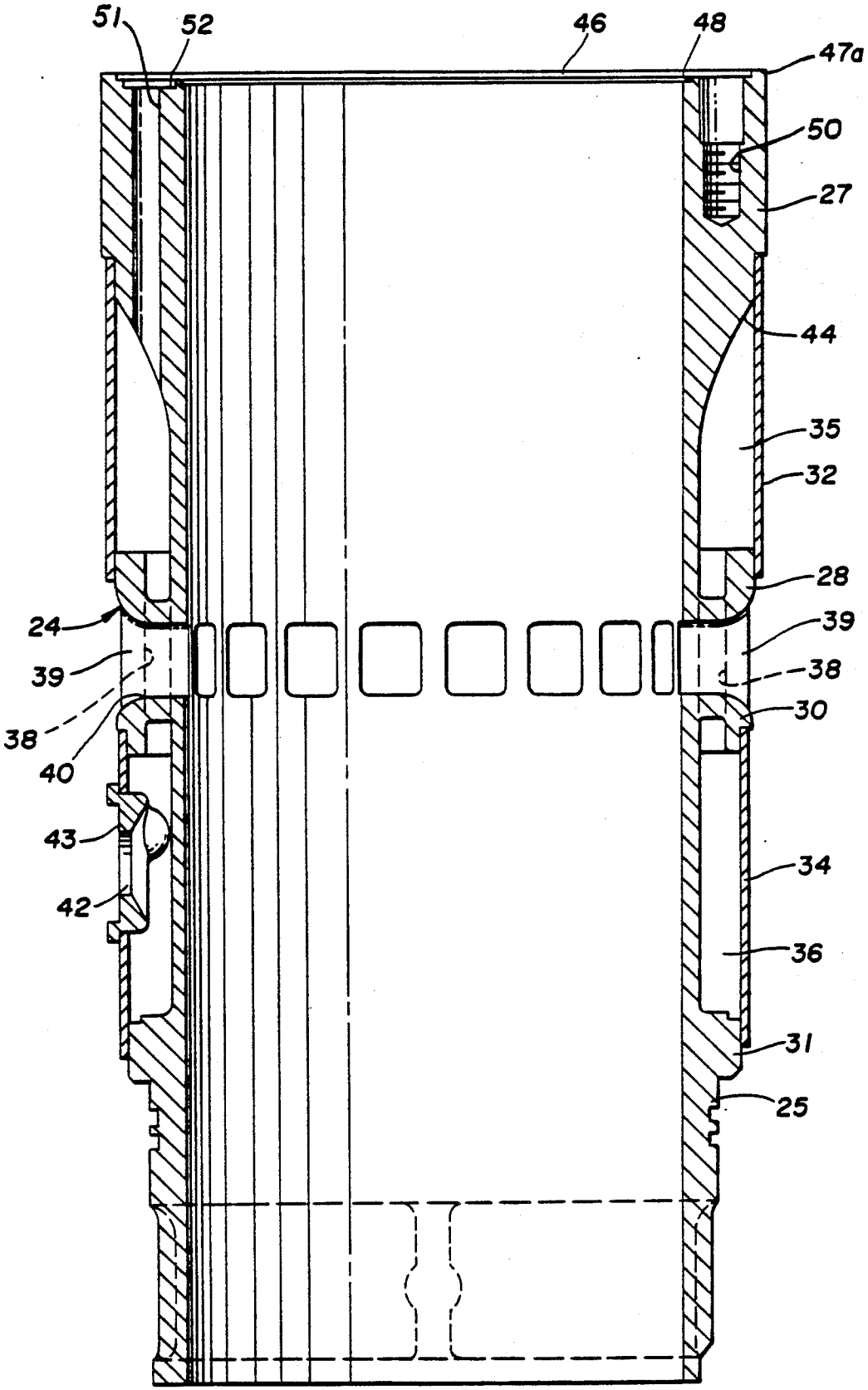
FIG. 3 is a cross-sectional view of the liner from the plane of line 3—3 of FIG. 2.

The cylinder liner 24 shown in FIGS. 1-3 is a body including a cast iron cylinder member fabricated 25. The cylinder member has a generally cylindrical inner bore wall 26 and a plurality of annular flanges 27, 28, 30,31. The flanges extend outwardly from the bore wall to receive upper and lower closure sleeves 32, 34 that are brazed or otherwise secured to the flanges and cooperate with them to define upper and lower annul coolant jackets 35, 36 surrounding upper and lower portions of the bore wall 26. If desired, the cylinder member 25 and the sleeves 32, 34 could be integrated and cast as a single member.

The coolant jackets 35, 36 are interconnected by cast passages 38 extending through columns 39 that define centrally located air inlet ports 40 and connect upper and lower portions of the liner. An inlet opening 42 through a flange 43 in the lower sleeve 34 provides for coolant flow into the lower jacket 36.

In accordance with the invention, the upper flange 27 which, at its lower end 44, radially joins the bore wall 26 with the jacket sleeve 32 is made uniformly heavy, without hollow portions, to form a distortion resistant rib-free annulus with a constant axial length that is greater than its radial thickness. The flange upper end 46 in assembly engages the periphery of the associated cylinder head fireface 18 and includes means for performing the mounting and sealing functions which are required.

At the outer edge, a raised rim 47 is provided to guide a mating portion of the connecting cylinder head barrel 17. At the inner edge, an annular recess 48 is provided to receive the wire compression gasket 14. Between these edges, there are eight equally annularly spaced threaded blind holes 50 in the flange which extend on axes parallel to the liner axis and open through the mounting end 46 to receive the axially extending liner studs 23. While the holes 50 are shown as counterbored, it is presently preferred to omit the countebored portion and provide full threads to the top as has been conventional in prior cylinder liners.

Between each of t stud holes 50, there are three accurately spaced and axially extending parallel coolant passages 51 which are drilled or otherwise formed connecting with the upper coolant jacket 35. More or fewer passages could be provided in each group if desired depending upon the space available. At their outer ends, the three passages 51 of each group are connected by manifold recesses 52 of accurately elongated shape resembling a short sausage formed in the flange end 46.

The manifold recesses 52 register in assembly with the inlet holes 22 of the associated cylinder head and act as manifolds to carry the coolant from each group of three passages 51 into the connecting one or two inlet holes 22 provided in the corresponding section of the head. The recesses 52 also receive the coolant seal assemblies 15 which extend around each group of passages 51 to seal the head to liner connection against coolant loss.

Figure 4:
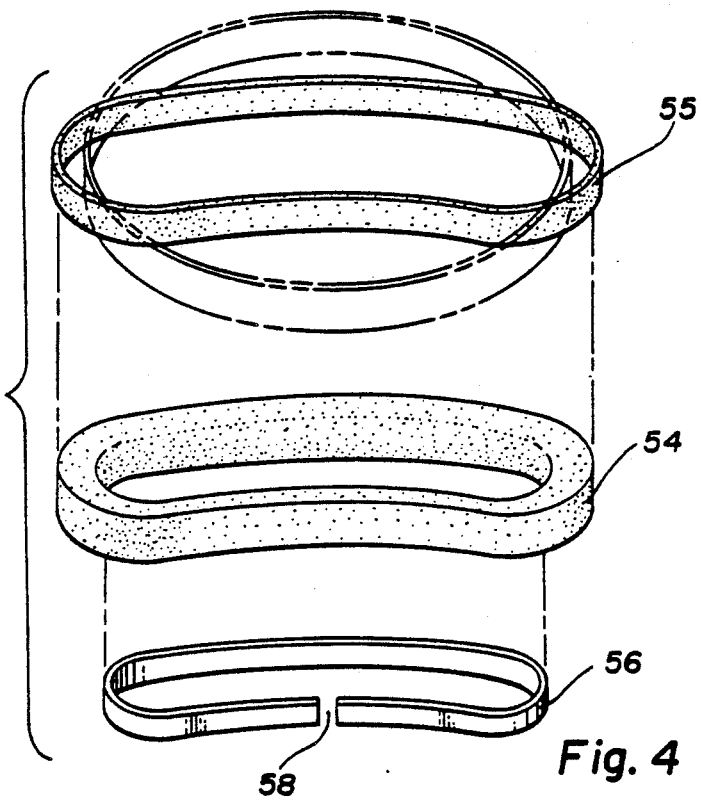
FIG. 4 is an exploded pictorial view of one of the coolant seal assemblies of FIG. 1.
Figure 5:
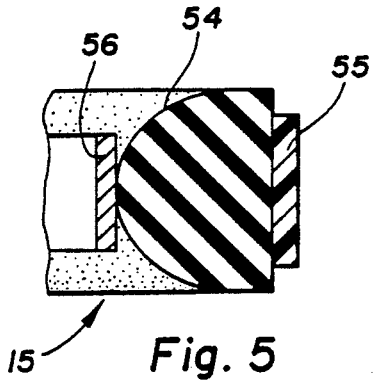
FIG. 5 is a cross-sectional view of the assembly (not exploded) from the plane of line 5—5 of FIG. 4.

The seal assemblies 15, best shown in FIGS. 4 and 5, may each include a seal 54, an insulator 55 and a ferrule or shield 56. Each seal is formed as an elongated resilient band shaped in the accurately elongated form to fit in the peripheries of the manifold recesses 52. Any suitable seal material and ring shape may be used but a D-shaped cross section as shown in FIG. 5 is presently preferred. Under some circumstances the seal could be used alone but in the preferred embodiment shown the exposure of the sealed interface to nearby exhaust gases and soot call for the addition of the insulator and shield.

The insulator 55 may be similar to the filled nylon rings used with grommets in prior cylinder liner seals of circular shape. Preferably the insulator is a flexible band made circular but formable into the elongated sausage shape when placed around the seal 54. In position, the insulator 55 protects the seal against exposure to high exhaust temperatures. Shield 56 is preferably formed as a rigid stainless steel band in the elongated shape of the interior of the seal 54. The band is preferably split on its inner side at 58 and, as assembled, protects the seal 54 against being forced inward due to exhaust pressures or the encroachment of soot buildup. The assembly as shown in FIG. 5 shows the variation in widths of the seal 54, insulator 55 and shield 56 to accommodate the necessary compression of the seal, the desired close fit of the flexible insulator and the support function of the rigid shield.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

What is claimed is:

1. An engine cylinder liner comprising a body defining a generally cylindrical inner bore wall spaced radially within an annular outer coolant jacket wall and an annular flange having amounting and sealing end and joining the bore and jacket walls at an opposite end to form a coolant jacket between the walls and adjacent the flange, a plurality of fastening means in the flange and opening to its mounting end at annularly spaced points axially aligned with the coolant jacket, a plurality of coolant passages between each spaced pair of the fastening means and extending axially through the flange from the coolant jacket, and manifold recesses in the flange mounting end, one between each spaced pair o the fastening means and interconnecting outer ends of the coolant passages located between each spaced pair of said fastening means.

2. An engine cylinder liner as in claim 1 wherein said body flange is of greater radial thickness than either of the walls and has an essentially constant axial length which is greater than its radial thickness.

3. An engine cylinder liner as in claim 1 wherein said fastening means each comprise a threaded blind opening, said blind openings having parallel axes.

4. An engine cylinder liner as in claim 3 wherein said fastening means each further comprise a stud threadedly received in each blind opening and extending from the flange on said parallel axes.

5. An engine cylinder liner comprising a body defining a generally cylindrical inner bore wall spaced radially within an annular outer coolant jacket wall and an annular flange having a mounting and sealing end and joining the bore and jacket walls at an opposite end to form a coolant jacket between the walls and adjacent the flange, a plurality of fastening means in the flange and opening to its mounting end at annularly spaced points axially aligned with the coolant jacket, a plurality of coolant passages between each spaced pair of the fastening means and extending axially through the flange from the coolant jacket, and manifold recesses in the flange mounting end, one between each spaced pair of the fastening means and interconnecting outer ends of he coolant passages located between each spaced pair of said fastening means, wherein said manifold recesses are each of accurately elongated configuration.

6. An engine cylinder liner as in claim 5 wherrein said flange further includes an annular recess at the inner edge of the mounting and saling end to receive a wire compression gasket.

7. A cylinder liner and seal assembly comprising a cylinder liner having a body defining a generally cylindrical inner bore wall spaced radially within an annular outer coolant jacket wall and an annular flange having a mounting and sealing end and joining the bore and jacket walls at an opposite end to form a coolant jacket between the walls and adjacent the flange, a plurality of fastening means in the flange and opening to its mounting end at annularly spaced points axially aligned with the coolant jacket, a plurality of coolant passages between each spaced pair of the fastening means and extending axially through the flange from the coolant jacket, manifoled recesses of accurately elongated configuration in the flange mounting end, one between each spaced pair of the fastening means and interconnecting outer ends of the coolant passages located between each spaced pair of said fastening means, and seal means in and extending along edges of the accurately elongated manifold recesses to surround said outer ends of the coolant passages and sealingly engage an associated cylinder head to limit coolant leakage from the manifold recesses at the cylinder head to liner interface.

8. A cylinder liner and seal assembly as in claim 7 wherein said seal means each comprises an accurately elongated band-like resilient seal formed to sealingly engage an associated manifold recess adjacent its edge.

9. A cylinder liner and seal assembly as in claim 8 wherein said seal means each further comprises a band of radially thin temperature resistant material sized to fit closely around the outer periphery of the associated seal to protect the seal against high external temperatures.

10. A cylinder liner and seal assembly as in claim 9 wherein each said seal means further comprises a band-like rigid ferrule engaging the inner periphery of the respective seal to prevent its collapse from external forces.

11. A cylinder liner and seal assembly as in claim 8 wherein each said seal means further comprises a band-like rigid ferrule engaging the inner periphery of the respective seal to prevent its collapse from external forces.

12. A seal assembly for use in accurately elongated manifold recesses of an engine cylinder liner to sealingly engage an associated cylinder head and limit coolant leakage from the manifold recesses at the cylinder head to liner interface, said seal assembly comprising an accurately elongated band-like resilient seal formed to sealingly engage an associated manifold recess adjacent its edge, and, a band-like rigid ferrule engaging the inner periphery of the respective seal to prevent its collapse from external forces.

13. A seal assembly as in claim 12 and further comprising a band of radially thin temperature resistant material fitted closely around the outer periphery of the associated seal to protect the seal against high external temperatures.

14. An engine cylinder liner comprising a body defining a generally cylindrical inner bore wall spaced radially within san annular outer coolant jacket wall and an annular flange having a mounting and sealing end and joining the bore an jacket walls at an opposite end to form a coolant jacket between the walls and adjacent the flange, a plurality of fastening means in the flange and opening to its mounting end at annularly spaced points axially aligned with the coolant jacket, and a plurality of coolant passages between each spaced pair of the fastening means and extending axially through the flange from the coolant jacket, wherein, with the exception of the coolant passages and fastening means, the flange is solid and has an axial length greater than its radial thickness.

* * * * *